US006178664B1

(12) United States Patent
Yant et al.

(10) Patent No.: US 6,178,664 B1
(45) Date of Patent: Jan. 30, 2001

(54) PROTECTIVE INSOLE INSERT FOR FOOTWEAR

(76) Inventors: Robert D. Yant, 236 N. Wind Ct.; Richard I. Polisner, 185 San Juan Dr., both of Ponte Vedra Bch., FL (US) 32082

( * ) Notice: Under 35 U.S.C. 154(b), the term of this patent shall be extended for 0 days.

(21) Appl. No.: 09/387,097

(22) Filed: Aug. 31, 1999

(51) Int. Cl.[7] ..... A43B 13/38; A43B 13/12

(52) U.S. Cl. ..... 36/44; 36/107; 36/73; 36/76 C

(58) Field of Search ..... 36/91, 73, 107, 36/108, 44, 43, 76 C, 30 R

(56) References Cited

U.S. PATENT DOCUMENTS

| | | | | |
|---|---|---|---|---|
| 1,676,170 | | 3/1928 | Troiel . | |
| 1,685,538 | | 7/1928 | Glidden et al. . | |
| 2,304,936 | | 8/1942 | Lewis . | |
| 2,803,895 | | 5/1957 | Frieder et al. . | |
| 2,808,663 | * | 10/1957 | Frieder et al. | 36/44 |
| 2,920,008 | * | 1/1960 | Frieder et al. | 36/44 |
| 4,271,607 | | 6/1981 | Funck . | |
| 4,404,757 | | 9/1983 | Sweeny . | |
| 4,481,726 | * | 11/1984 | Phillips | 36/30 R |
| 4,888,888 | | 12/1989 | Ashton . | |
| 5,003,709 | | 4/1991 | Okayasu et al. . | |
| 5,042,174 | * | 8/1991 | Nichols | 36/30 R |
| 5,285,583 | | 2/1994 | Aleven . | |
| 5,996,255 | * | 12/1999 | Ventura | 36/44 |

FOREIGN PATENT DOCUMENTS

| | | |
|---|---|---|
| 1594908 | 8/1977 | (GB) . |

* cited by examiner

*Primary Examiner*—M. D. Patterson
(74) *Attorney, Agent, or Firm*—Thomas C. Saitta

(57) ABSTRACT

A puncture proof insole insert formed of multiple layers of flexible metal sheets, the insert being capable of stopping penetration by a sharp object at forces up to 60 foot pounds in the ball area of the foot and up to 80 foot pounds in the heel area of the foot, there being a greater number of metal sheets in the heel area than in the ball area. The device may further incorporate cushioning or fabric layers, and may be formed with a raised arch or other orthotic shape. The device is preferably constructed of layers of 17-7 stainless steel with each layer having a thickness of 0.015 inches.

19 Claims, 1 Drawing Sheet

PROTECTIVE INSOLE INSERT FOR FOOTWEAR

BACKGROUND OF THE INVENTION

This invention relates generally to insole inserts for footwear which provide protection against penetration of sharp objects through the insole insert, and more particularly relates to insole inserts, whether incorporated into the construction of the footwear itself or fabricated as a separate insert to be positioned inside the completed shoe, which comprise multiple layers of a stainless steel material which is puncture proof under typical conditions expected to be encountered by the user.

Many commercial and construction situations present the danger of sharp object penetration through the soles of footwear worn by workers. A most common example is the presence of nails around construction sites. This dangerous but relatively unavoidable situation results in large numbers of injuries to workers with accompanying lost man-hours, pain suffering, morbidity, infection and medical costs for treatment. Much development has been directed at creating protective footwear which lessens the danger of injury from stepping, jumping or falling onto sharp objects, but much of this development has failed due to the need to balance a high degree of protection with comfort and wearability, since the sole must remain flexible. For example, a relatively thick metal plate is puncture proof under typical conditions but the inflexibility prevents its use as a solution. True puncture prevention rather than mere puncture resistance is difficult to attain. Most of the attempts to create protective footwear have resulted in the creation of footwear which is puncture resistant rather than puncture proof—the typical devices failing to prevent puncture by sharp objects at high impact energy. A 230 pound individual jumping from a height of ten feet generates approximately 60 foot pounds (81.3 joules) on the ball of the foot and approximately 80 foot pounds (108.5 joules) on the heel of the foot, the difference in values resulting from the ability of the foot and leg to better absorb and distribute the force in the ball area rather than at the heel. Exceeding this standard is the goal of a puncture proof insert.

Representative patents showing prior art devices of this nature are such as U.S. Pat. No. 2,803,895 to Frieder et al., showing a multi-layer protective sole consisting of synthetic, resin-impregnated, fibrous laminates, and U.S. Pat. No. 5,285,583 to Aleven, showing a protective insole which incorporates a protective plastic layer between an insole board and a fabric liner. More closely related to the invention at hand are the patents issued to Ashton, Funck and Okayasu et al. The Ashton patent, U.S. Pat. No. 4,888,888, shows a sole formed from a number of small hinged metal plate members joined in the nature of chain mail or two metal plates hinged at the ball position to provide flexibility. The two plate hinged construction does little to increase comfort to the wearer, and the multi-plate chain mail construction is not cost effective with regard to manufacture. The patent to Funck, U.S. Pat. No. 4,271,607, teaches incorporating a single metal plate approximately 0.02 inches thick in the sole of the footwear. Such a device would not meet the prevention requirements for designating the insert puncture proof as opposed to puncture resistant. U.S. Pat. No. 5,003,709 to Okayasu et al. teaches the use of multiple thin metal foils to increase the penetration protection without sacrificing flexibility, but the metal foils are only approximately 0.001 inches thick and even when used in multiple layers as taught would not provide complete protection against punctures unless an exorbitant number of layers were combined, a fact acknowledged in that patent at column 1, lines 29–34. The Okayasu et al. patent also teaches a construction where the foil layers are used only in the ball area and the remainder of the sole is constructed from non-flexible thick metal sheets, a construction which increases the puncture protection in the heel area but which sacrifices flexibility and comfort while increasing manufacturing difficulty and cost. In addition, all of the prior known art provides a planar insole suitable only for incorporation into the footwear prior to manufacture or for use with footwear having no raised arch support. Other patents which include metal in the shoe to provide extra protection are U.S. Pat. No. 2,304,936 to Lewis, U.S. Pat. No. 1,685,538 to Glidden et al., U.S. Pat. No. 4,404,757 to Sweeny and U.S. Pat. No. 1,676,170 to Troiel. The Lewis, Sweeny and Troiel involve multi-component pieces which involve complicated manufacturing steps and severely reduce flexibility. Glidden et al. discloses a weak insert with apertures.

It is an object of this invention to provide a puncture proof insert able to prevent penetration through the insert at energies up to 60 foot pounds in the ball of the foot region and 80 foot pounds in the heel region, while retaining suitable flexibility so as not to impair the comfort and wearability of the insert. It is a further object to provide such an insert where the protection is provided by multiple layers of thin metal sheets and where the number of such sheets is less in the ball region where maximum flexibility is required and greater in the heel region where less flexibility is needed and greater penetration protection is required. It is a further object to provide such an insert in which the metal sheets are approximately 0.015 inches in thickness and where two such sheets are present in the ball region and three sheets are present in the heel region. It is a further object to provide such a puncture proof insole insert which can be incorporated into the body of the footwear during manufacture or which can be constructed as a separate device insertable into the footwear after manufacture. It is a further object to provide such an insert which incorporates a raised arch support region for better adaption to the foot of the user and which allows its use as a separate insert in existing footwear having the raised arch support. It is a further object to provide such a puncture proof insole insert which can be shaped for use as an orthotic device.

SUMMARY OF THE INVENTION

The invention comprises in general an insole insert which protects the entire sole area of the foot and which is puncture proof at energies up to 60 foot pounds in the ball region of the foot and puncture proof at energies up to 80 foot pounds in the heel region, which is composed of multiple layers of thin metal sheet material. The insert insole can be incorporated as an internal component of footwear during the manufacturing process, or can be constructed as a separate device to be placed into already manufactured footwear. The number of layers of material is preferably less in the ball region of the insert than in the heel region of the insert. The metal sheet material is preferably composed of 17-7 stainless steel which is solution heat treated and cold rolled and each layer is approximately 0.015 inches in thickness. The layers are joined by adhesives or spot-welding when constructed as part of a separate insert to be placed inside finished footwear, and in this adaption further preferably incorporate one or more layers of fabric or cushioning material. The insert construction may also be formed to incorporate a raised arch support region or other orthotically desirable shape.

DETAILED DESCRIPTION OF THE INVENTION

Figure 1:
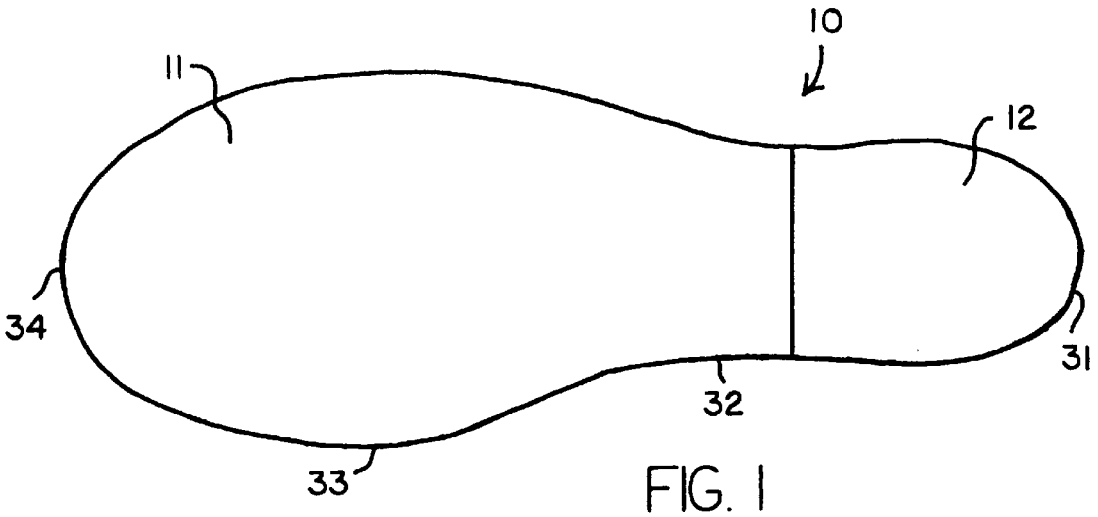
FIG. 1 is a top view of the invention.
Figure 2:
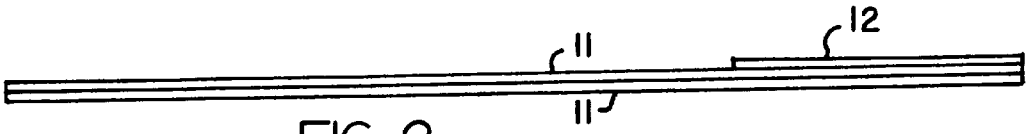
FIG. 2 is a side view.

With reference now to the drawings, the invention will be described in detail with regard to the best mode and preferred embodiment. As shown in FIGS. 1 and 2, the invention comprises in general an insole insert 10 configured in general shape to match the external profile of the human foot and sized according to the insole profile of standard footwear, the insert 10 having a generally rounded heel portion 31, a generally tapered arch portion 32, an expanded ball portion 33, and a generally rounded or pointed toe portion 34. The insert 10 comprises a plural number of thin metal sheet full members 11 and an additional partial thin metal sheet heel member 12. The full members 11 are configured to create the overall profile of the insert 10, covering the heel, arch, ball and toe portions 31, 32, 33, 34, while the heel member 12 is configured to match the overall profile only in the heel portion 31, the heel member 12 being truncated somewhere in the arch region 32.

The full members 11 and heel member 12 are each constructed of a thin metal sheet material having very high puncture resistance, such that two layers of full members 11 are puncture proof to sharp objects at an energy up to 60 foot pounds (81.3 joules) and such that three layers are puncture proof to sharp objects at an energy of 80 foot pounds (108.5 joules). These energies represent the equivalent of a 230 pound individual falling from a height of ten feet and landing on one foot. The energies which must be defeated to prevent puncture during routine standing, walking or stepping are of course much less. Puncture proof means that the multiple layers were not completely penetrated by the sharp object.

The full members 11 and heel member 12 are preferably constructed from sheets of a stainless steel alloy comprising roughly 17 wt. percent chromium, 7 wt. percent nickel and 1 wt. percent aluminum, commonly referred to as a 17-7 stainless steel. The metal sheets 11 and 12 are approximately 0.015 inches in thickness, thereby allowing for significant flexibility. The preferred stainless steel alloy is solution heat treated (annealed) by heating the material to approximately 1950 degrees F for approximately 1 minute and then cold rolled for hardness. The material as treated has a tensile strength in excess of 200,000 psi, a yield strength at 0.2% offset in excess of 175,000 psi, an elongation in 2 inches of 1%, and a hardness not lower than 41 HRC.

Figure 3:
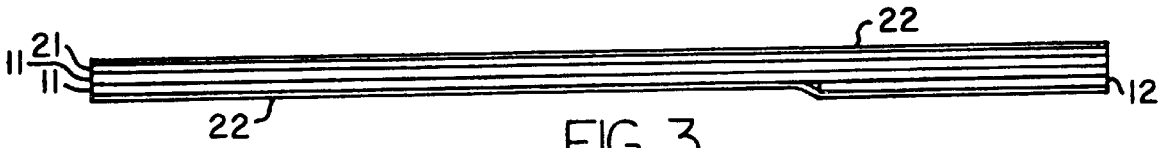
FIG. 3 is a side view of an alternative embodiment of the invention, illustrating an embodiment including additional fabric and cushioning layers and also showing the third metal sheet layer positioned on the bottom of the other two metal sheet layers.

The insert 10 is constructed as a multi-layer device as shown in FIG. 2 to have two full members 11 and a single heel member 12, although additional heel members 12 can be incorporated if desired to increase the protection even further. This construction allows the insert 10 to be more flexible in the ball region 33 where it is necessary for comfort and useability, while simultaneously allowing the insert 10 to provide greater protection in the heel region 31 where flexibility is not required, but a higher force stoppage is. The two layers of full members 11 prevent penetration at energies up to 60 foot pounds in the toe region 34, ball region 33 and arch region 32, while the three layers formed by the combination of two full members 11 and one heel member 12 prevent penetration at energies up to 80 foot pounds in the heel region 31. The full members 11 and heel member 12 may be joined by suitable methods, such as adhesives or spot welding, if required. Heel member 12 may be positioned beneath the two full members 11, as shown in FIG. 3 or between the two full members 11.

Where the insert 10 is not to be incorporated directly into the structure of the footwear during manufacture, additional layers of material may be added, as shown in FIG. 3. A cushioning layer 21, formed from a polymer foam material or the like, may be attached on top of the uppermost metal sheet layers 11 and 12, with additional fabric layers 22 placed on the top and bottom. This construction is especially suitable where the insert 10 is intended for use as a separate device to be placed into existing shoes.

Figure 4:
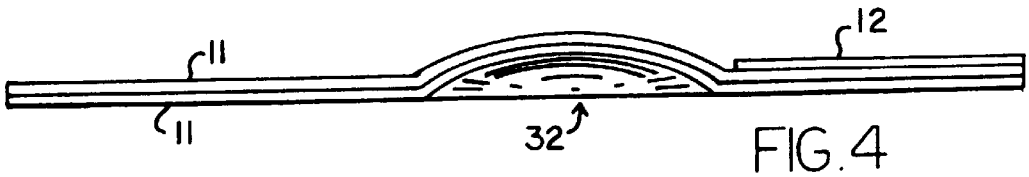
FIG. 4 is a side view of another embodiment showing the insert configured with a raised arch portion.

Another alternative embodiment is illustrated in FIG. 4. It is preferred that footwear provide a raised arch support configured to match the raised arch of the human foot. To provide for better support when the insert 10 is incorporated into footwear during manufacture, to provide better support when the insert 10 is placed as a separate device into already existing footwear, and to allow the insert 10 to be used in existing footwear which has a built-in arch support in the insole, the insert 10 may be configured with a raised arch region 32, since the sheet material is thin enough to be moldable. This moldability further allows the insole insert 10 to be utilized as an orthotic device configured as required for correction of deficiencies.

It is contemplated that obvious equivalents or substitutions may be apparent to those skilled in the art, and therefore the true scope and definition of the invention is to be as set forth in the following claims.

We claim:

1. An insole insert for footwear having a heel portion, an arch portion, a ball portion and a toe portion, said insert comprising multiple layers of flexible metal sheet members, said sheet members having a combined resistance to puncture such that said sheet members are puncture proof to sharp objects at forces up to 60 foot pounds in said ball portion and up to 80 foot pounds in said heel portion, where said sheet members comprise two full sheet members covering said heel, arch, ball and toe portions, and one heel member covering only said heel area, where each of said sheet members has a tensile strength greater than 200,000 psi, a yield strength at 0.2% offset in excess of 175,000 psi, and elongation in 2 inches of 1% and a hardness of at least 41 HRC.

2. The device of claim 1, where said sheet members are approximately 0.015 inches in thickness.

3. The device of claim 1, where said sheet members are formed of solution heat treated, cold rolled 17-7 stainless steel.

4. The device of claim 1, further incorporating a raised arch area.

5. The device of claim 1, where said insole insert is in the shape of an orthotic.

6. The device of claim 1, further comprising a cushioning layer.

7. The device of claim 1, further comprising at least one fabric layer.

8. The device of claim 1, where said sheet members are adhesively joined together.

9. The device of claim 1, where said sheet members are joined by spot welding.

10. An insole insert for footwear having a heel portion, an arch portion, a ball portion and a toe portion, said insert consisting essentially of three layers of flexible metal sheet members, said sheet members having a combined resistance to puncture such that said sheet members are puncture proof to sharp objects at forces up to 60 foot pounds in said ball portion and up to 80 foot pounds in said heel portion, where two of said sheet members are full sheet members covering said heel, arch, ball and toe portions, and where one of said sheet members is a heel member covering only said heel area.

11. The device of claim 10, where said sheet members are approximately 0.015 inches in thickness.

12. The device of claim 10, where said sheet members are formed of solution heat treated, cold rolled 17-7 stainless steel.

13. The device of claim 10, further incorporating a raised arch area.

14. The device of claim 10, where said insole insert is in the shape of an orthotic.

15. The device of claim 10, further comprising a cushioning layer.

16. The device of claim 10, further comprising at least one fabric layer.

17. The device of claim 10, where said sheet members are adhesively joined together.

18. The device of claim 10, where said sheet members are joined by spot welding.

19. The device of claim 10, where each of said sheet members has a tensile strength greater than 200,000 psi, a yield strength at 0.2% offset in excess of 175,000 psi, and elongation in 2 inches of 1% and a hardness of at least 41 HRC.

* * * * *